US007540377B1

(12) United States Patent
Krisher

(10) Patent No.: US 7,540,377 B1
(45) Date of Patent: Jun. 2, 2009

(54) COMBINED GREETING CARD AND SOCK HOLDING APPARATUS

(76) Inventor: Travis M. Krisher, 4731 Fisher Drive, Richmond, Vancouver (CA) V6X 3V4

( * ) Notice: Subject to any disclaimer, the term of this patent is extended or adjusted under 35 U.S.C. 154(b) by 677 days.

(21) Appl. No.: 11/065,608

(22) Filed: Feb. 25, 2005

(51) Int. Cl.
*B65D 85/18* (2006.01)

(52) U.S. Cl. ..... 206/295; 206/299; 206/292; 206/288

(58) Field of Classification Search ..... 206/278–299; D9/415
See application file for complete search history.

(56) References Cited

U.S. PATENT DOCUMENTS

| | | | | | |
|---|---|---|---|---|---|
| 646,638 | A * | 4/1900 | Cutler | 229/75 |
| 1,594,363 | A | 8/1926 | Glick | |
| 3,329,386 | A * | 7/1967 | Rosen | 248/340 |
| 3,651,928 | A * | 3/1972 | Weisman | 206/782 |
| 4,014,436 | A * | 3/1977 | Tunis | 206/494 |
| 4,043,449 | A | 8/1977 | Love | |
| 4,190,151 | A * | 2/1980 | Russell | 206/281 |
| 4,240,553 | A * | 12/1980 | Leopold | 206/296 |
| 4,257,552 | A * | 3/1981 | Farkas et al. | 236/1 R |
| 4,440,298 | A | 4/1984 | Knight | |
| 4,678,079 | A | 7/1987 | Henning | |
| D319,843 | S | 9/1991 | Thornell | |
| 5,469,959 | A * | 11/1995 | Gummer | 206/299 |
| 5,515,966 | A * | 5/1996 | Hodge et al. | 206/292 |
| 5,522,499 | A | 6/1996 | DeBiasio et al. | |
| 6,170,665 | B1 | 1/2001 | Pehr | |
| 6,622,858 | B1 * | 9/2003 | Wilkinson et al. | 206/299 |
| 2002/0130055 | A1 | 9/2002 | Morrison, Jr. | |

* cited by examiner

*Primary Examiner*—Tri M Mai

(57) ABSTRACT

An apparatus includes a unitary body that includes a front section with planar front and rear surfaces. A rear section is spaced from the front section and extends parallel thereto. The body also includes a shoulder portion monolithically formed with the front and rear sections, which is provided with perforations. The body is articulatable along the perforations such that same can be adapted between folded and unfolded positions. The body further includes a finger portion monolithically formed with the front section that is provided with perforations. The finger portion is laterally registered with one of the openings such that same can be inserted therethrough. Another one of the openings receives a fastening member therethrough and supports the body at an elevated position. At least one sock is intercalated between the front and rear sections.

4 Claims, 3 Drawing Sheets

COMBINED GREETING CARD AND SOCK HOLDING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to greeting cards and, more particularly, to a combined greeting card and sock holding apparatus.

2. Prior Art

Generally, greeting cards of the birthday or Christmas type are sent in an envelope and contain a message written by the sender therein. These types of cards are not suitable for sending a large item, such as clothing apparel. The use of greeting cards with the ability to mount another item therein is well known in the prior art.

One example shows greeting card blanks which enable a sender to mount a personally selected picture, either in the form of a postcard or photographic print therein. The purpose of these prior art blanks is to allow each person to choose the picture carried by the card thereby adding a personal contribution to the design as a whole. These cards, however, are not suitable for sending larger items either, thus a person is still required to place the item they wish to send in a separate box and pay the postal fees in addition to the card's postal fees.

Another example discloses a gift card for a flexible article, such as a garter, wherein the article is mounted on the bottom leaf of a folded card, and is made to extend through a cutaway opening in the other, the top leaf. Although the Goldsmith patent does recognize that a picture or ornamentation may be provided on the card, no suggestion is made that the gift article become a part of the decorative aspect of the card, nor is there any suggestion that the card and gift be associated with a container and sold as a packaged gift article.

Again, the possibility of sending a larger item, like a pair of socks or boxers is not possible through the use of the previously mentioned cards. Sending such items, however, would be a unique way to show you care for an individual at the time of their birthday or at Christmas.

Accordingly, a need remains for a combined greeting card and sock holding apparatus in order to overcome the above-noted shortcomings. The present invention satisfies such a need by providing a card that has a convenient two-in-one design and is able to convey a message in a fun, new way. Such an apparatus combines a gift of casual or sports socks together with a greeting card. Whenever those socks are worn by the recipient, they will be reminded of the sender and the uniqueness of the gift. The combined greeting card and sock holding apparatus will also reduce the cost associated with mailing such items since only one package has to be sent.

BRIEF SUMMARY OF THE INVENTION

In view of the foregoing background, it is therefore an object of the present invention to provide a combined greeting card and sock holding apparatus. These and other objects, features, and advantages of the invention are provided by a combined greeting card and gift-holding apparatus.

The apparatus includes a greeting card that has a unitary and continuous body adaptable between alternate shapes. Such a body includes a substantially rectangular front section that has planar front and rear surfaces provided with a centrally disposed longitudinal axis.

The body further includes a rear section provided with a centrally disposed longitudinal axis spaced from the front section axis and extending parallel thereto. Such a rear section is provided with a plurality of openings formed therein and spaced apart adjacent to opposed end portions of the rear section. The rear section preferably has a top edge situated above a top edge of the front section such that a top end portion of the sock can be visually identified during packaged conditions. The front and rear sections preferably maintain an adjustable spatial relationship at the folded position defined by a thickness of the sock.

The body also includes a shoulder portion monolithically formed with the front and rear sections and medially situated therebetween. Such a shoulder portion preferably has top and bottom edge portions flaring outwardly away from the front section for effectively supporting the rear section at a substantially stable position. The shoulder portion is further provided with a plurality of perforations defining lines of weakness registered substantially parallel to the front and rear section axes respectively. The shoulder portion perforations may be spaced apart and maintain a fixed spatial relationship along outer edge portions of the front and rear sections respectively. The body is selectively articulatable along the perforations such that the front and rear sections can be selectively adapted between folded and unfolded positions.

The body also further includes a finger portion monolithically formed with the front section and protruding laterally away therefrom. Such a finger portion is provided with a plurality of perforations defining lines of weakness such that the finger portion can be selectively adapted between linear and bent positions. The finger portion perforations define a fulcrum axis and a secondary axis such that the male tip can be effectively positioned with the one opening.

The finger portion is laterally registered with one of the openings such that the finger portion can be removably inserted therethrough and advantageously maintain the body at a folded position. Another one of the openings is sized and shaped for receiving a fastening member therethrough and supporting the body at an elevated position. The finger portion preferably has a monolithically formed male tip provided with a plurality of lip regions engageable about a perimeter of the one opening such that the finger portion can be effectively maintained at a locked position after the front and rear sections are articulated towards each other.

At least one sock is removably intercalated between the front and rear sections such that a recipient can conveniently readily identify surface indicia on the front and rear sections without removing the sock from the body.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
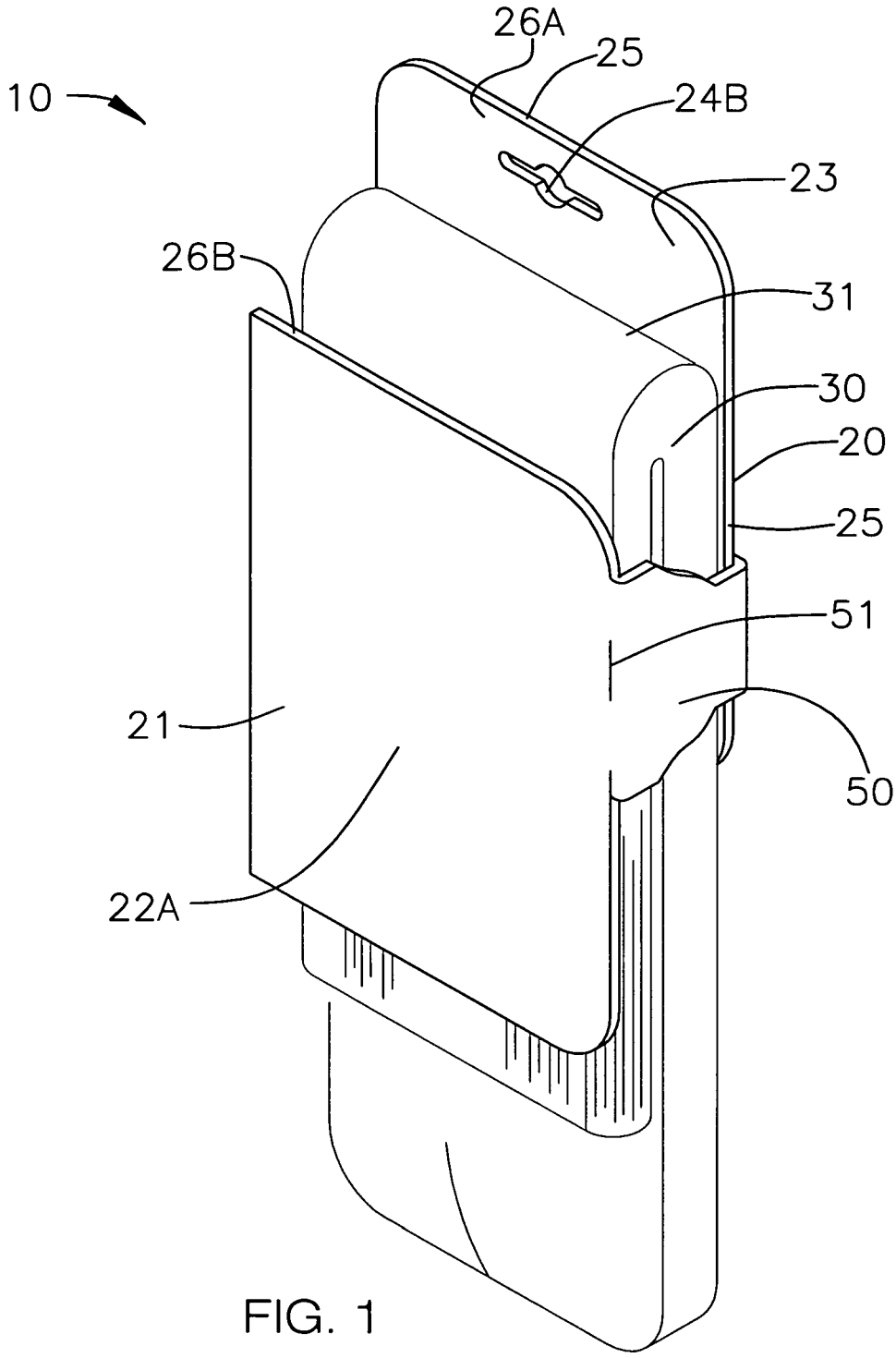
FIG. 1 is a perspective view showing a combined greeting card and sock holding apparatus, in accordance with the present invention.
Figure 2:
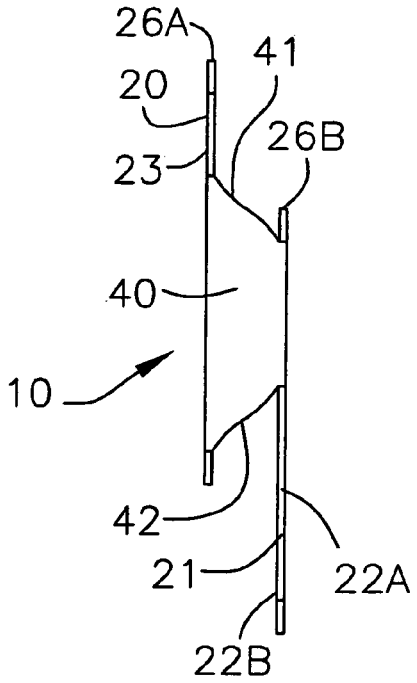
FIG. 2 is a right side-elevational view of the apparatus shown in FIG. 1.
Figure 3:
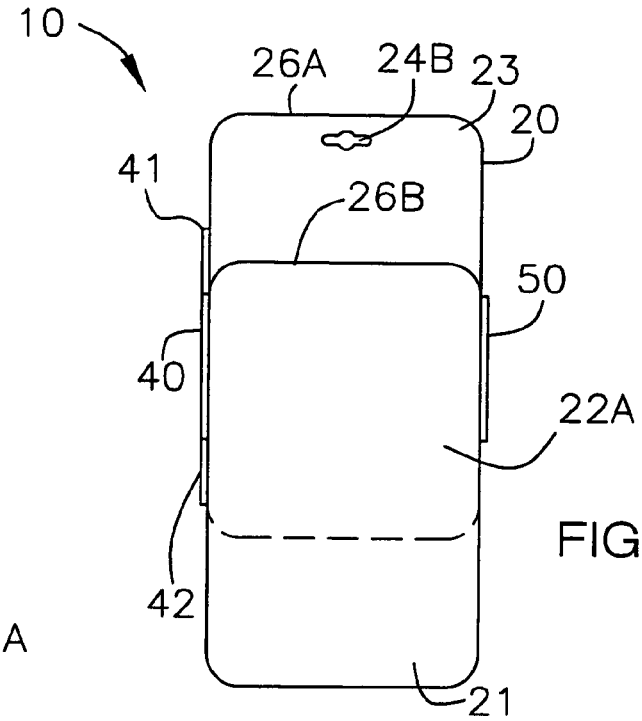
FIG. 3 is front-elevational view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-6 by the reference numeral 10 and is intended to provide a combined gift card and sock holding apparatus. It should be understood that the apparatus 10 may be used to hold many different types of socks and should not be limited in use to only holding casual socks.

Referring initially to FIG. 1, the apparatus 10 includes a greeting card that has a unitary and continuous body 20 adaptable between alternate shapes. Such a body 20 includes a substantially rectangular front section 21 that has planar front 22A and rear 22B surfaces provided with a centrally disposed longitudinal axis. Of course, the body 20 may be produced in a variety of different shapes, sizes and colors, as is obvious to an individual skilled in the art.

Referring to FIGS. 1 through 6, the body 20 further includes a rear section 23 provided with a centrally disposed longitudinal axis spaced from the front section axis and extending parallel thereto. Such a rear section 23 is provided with a plurality of openings 24 formed therein and spaced apart adjacent to opposed end portions 25 of the rear section 23. The rear section 23 has a top edge 26A situated above a top edge 26B of the front section 21 such that a top end portion 31 of the sock 30 (described herein below) can be visually identified during packaged conditions. The front 21 and rear 23 sections maintain an adjustable spatial relationship at the folded position defined by a thickness of the sock 30.

Referring to FIGS. 2 through 6, the body 20 also includes a shoulder portion 40 monolithically formed with the front 21 and rear 23 sections and medially situated therebetween. Such a shoulder portion 40 has top 41 and bottom 42 edge portions flaring outwardly away from the front section 21 for effectively supporting the rear section 23 at a substantially stable position. The shoulder portion 40 is further provided with a plurality of perforations 43 defining lines of weakness registered substantially parallel to the front 21 and rear 23 section axes respectively. The shoulder portion perforations 43 are spaced apart and maintain a fixed spatial relationship along outer edge portions of the front 21 and rear 23 sections respectively. The body 20 is selectively articulatable along the perforations 43 such that the front 21 and rear 23 sections can be selectively adapted between folded and unfolded positions.

Figure 5:
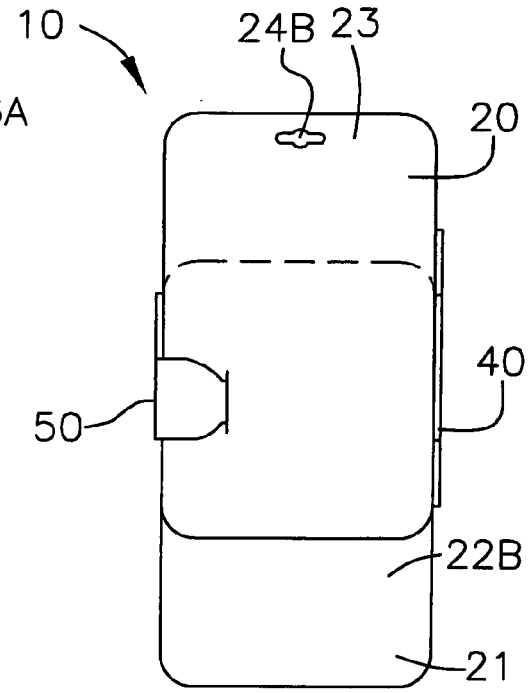
FIG. 5 is rear elevational view of the apparatus shown in FIG. 1.
Figure 6:
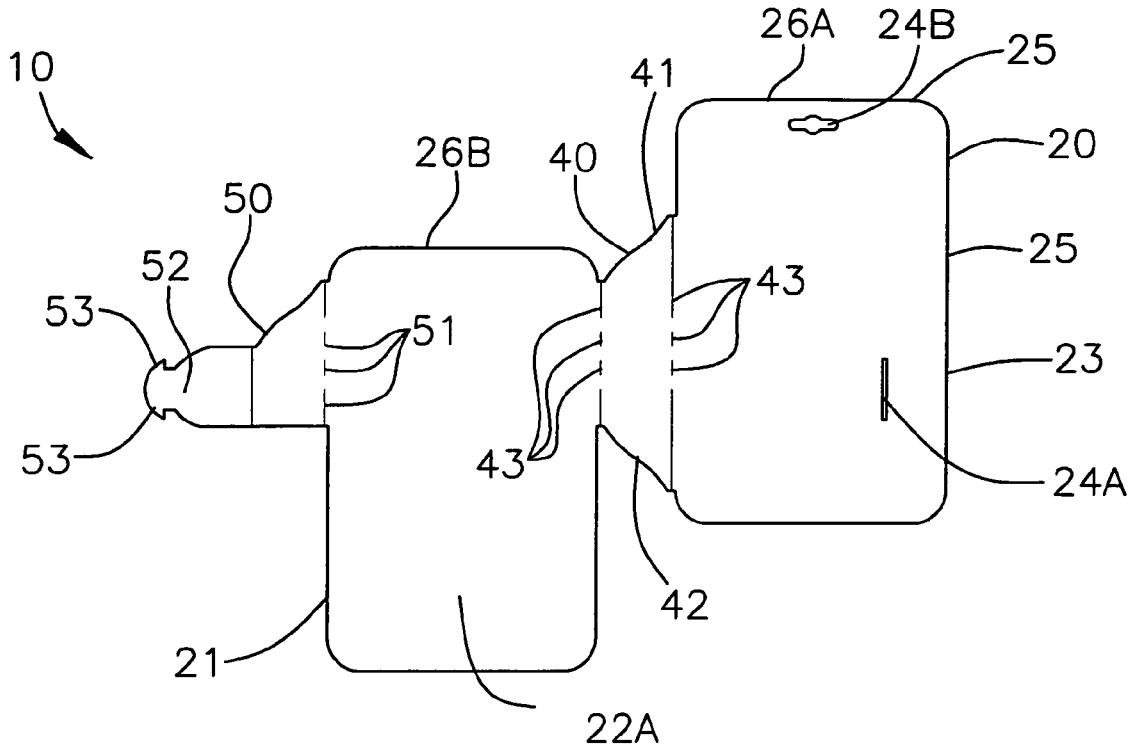
FIG. 6 is a top plan view of the apparatus shown in FIG. 1, showing the apparatus at a disengaged and fully expanded position.

Referring to FIGS. 1, 5 and 6, the body 20 also further includes a finger portion 50 monolithically formed with the front section 21 and protruding laterally away therefrom. Such a finger portion 50 is provided with a plurality of perforations 51 defining lines of weakness such that the finger portion 50 can be selectively adapted between linear and bent positions. The finger portion perforations 51 define a fulcrum axis and a secondary axis such that the male tip 52 (described herein below) can be effectively positioned with the one opening 24A. Obviously, the finger portion 50 and the rear section 23 may be provided with alternate ways of maintaining the front 21 and rear 23 sections connected such as Velcro or magnets, as is well known to a person skilled in the art.

Figure 4:
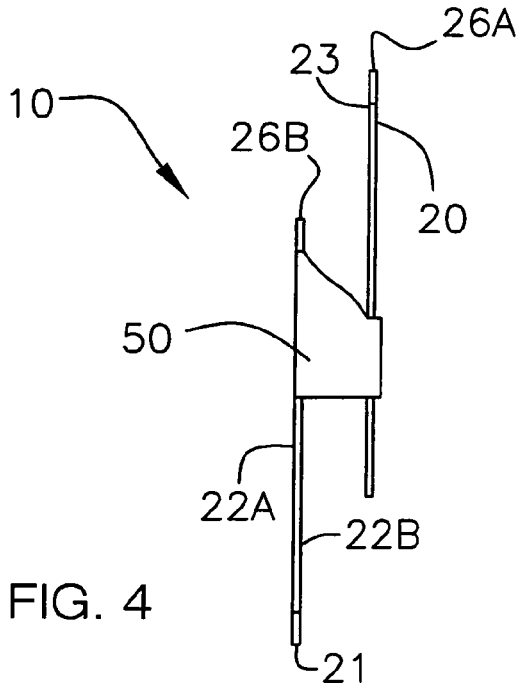
FIG. 4 is left side-elevational view of the apparatus shown in FIG. 1.

Referring to FIGS. 4 and 5, the finger portion 50 is laterally registered with one 24A of the openings 24 such that the finger portion 50 can be removably inserted therethrough and advantageously maintain the body 20 at a folded position. Another one 24B of the openings 24 is sized and shaped for receiving a fastening member (not shown) therethrough and supporting the body 20 at an elevated position. Such another opening 24B advantageously allows the apparatus 10 to be displayed easily for selling purposes. The finger portion 50 has a monolithically formed male tip 52 provided with a plurality of lip regions 53 engageable about a perimeter of the one opening 24A such that the finger portion 50 can be effectively maintained at a locked position after the front 21 and rear 23 sections are articulated towards each other.

Referring to FIG. 1, at least one sock 30 is removably intercalated between the front 21 and rear 23 sections such that a recipient can conveniently readily identify surface indicia on the front 21 and rear 23 sections without removing the sock 30 from the body 20. Of course, the surface indicia may convey a plethora of messages, including but not limited to, happy birthday wishes, Christmas blessings etc., as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined greeting card and gift-holding apparatus, said apparatus comprising:

a greeting card having a unitary and continuous body adaptable between alternate shapes, said body including a substantially rectangular front section having planar front and rear surfaces provided with a centrally disposed longitudinal axis, said body further including a rear section provided with a centrally disposed longitudinal axis spaced from said front section axis and extending parallel thereto, said rear section being provided with a plurality of openings formed therein and spaced apart adjacent opposed end portions of said rear section, said body further including a shoulder portion monolithically formed with said front and rear sections and medially situated therebetween, said shoulder portion being provided with a plurality of perforations defining lines of weakness registered substantially parallel to said front and rear section axes respectively, said finger portion perforations define a fulcrum axis and a secondary axis such that said male tip can be effectively positioned with the one opening, said body being selectively articulatable along said perforations such that said front and rear sections can be selectively adapted between folded and unfolded positions, said body further including a finger portion monolithically formed with said front section and protruding laterally away therefrom, said finger portion being provided with a plurality of perforations defining lines of weakness such that said finger portion can be selectively adapted between linear and bent positions, said finger portion being laterally registered with one of the openings such that said finger portion can be removably inserted therethrough and maintain said body at a folded position, another one of the openings is sized and shaped for receiving a fastening member therethrough and supporting said body at an elevated position; and at least one sock removably intercalated between said front and rear sections such that a recipient can readily identify surface indicia on said front and rear sections without removing said sock from said body;

wherein said front section has a bottom edge situated below a bottom edge of said rear section;

wherein said shoulder portion has top and bottom edge portions flaring outwardly away from a medially situated longitudinally edge of said front section for effectively supporting said rear section at a substantially stable position;

wherein said should portion is disposed at an upper region of said front section;

wherein said rear section has a top edge situated above a top edge of said front section such that a top end portion of said sock can be visually identified during packaged conditions.

2. The apparatus of claim 1, wherein said front and rear sections maintain an adjustable spatial relationship at the folded position defined by a thickness of said sock.

3. The apparatus of claim 1, wherein said shoulder portion perforations are spaced apart and maintain a fixed spatial relationship along outer edge portions of said front and rear sections respectively.

4. The apparatus of claim 1, wherein said finger portion has a monolithically formed male tip provided with a plurality of lip regions engageable about a perimeter of the one opening such that said finger portion can be effectively maintained at a locked position after said front and rear sections are articulated towards each other.

* * * * *